US006218819B1

(12) United States Patent
Tiwari

(10) Patent No.: US 6,218,819 B1
(45) Date of Patent: Apr. 17, 2001

(54) VOLTAGE REGULATION DEVICE HAVING A DIFFERENTIAL AMPLIFIER COUPLED TO A SWITCHING TRANSISTOR

(75) Inventor: Vineet Tiwari, Aix en Provence (FR)

(73) Assignee: STMicroelectronics S.A., Gentilly (FR)

( * ) Notice: Subject to any disclaimer, the term of this patent is extended or adjusted under 35 U.S.C. 154(b) by 0 days.

(21) Appl. No.: 09/408,082

(22) Filed: Sep. 29, 1999

(30) Foreign Application Priority Data

Sep. 30, 1998 (FR) ..... 98 12199

(51) Int. Cl.[7] ..... G05F 1/44; G05F 1/56; G05F 1/40

(52) U.S. Cl. ..... 323/285; 323/274

(58) Field of Search ..... 323/273, 274, 323/275, 282, 284, 285

(56) References Cited

U.S. PATENT DOCUMENTS

| | | | | |
|---|---|---|---|---|
| 5,010,292 | * | 4/1991 | Lyle, Jr. | 323/274 |
| 5,025,204 | * | 6/1991 | Su | 323/274 |
| 5,408,173 | | 4/1995 | Knapp | 323/285 |
| 5,548,205 | * | 8/1996 | Monticelli | 323/274 |
| 5,686,820 | * | 11/1997 | Riggio, Jr. | 323/273 |
| 5,686,821 | * | 11/1997 | Brokaw | 323/273 |
| 5,811,861 | | 9/1998 | Nunokawa | 323/282 |
| 5,828,204 | * | 10/1998 | Jansen | 323/266 |
| 5,828,206 | * | 10/1998 | Hosono et al. | 323/273 |

FOREIGN PATENT DOCUMENTS 0 811 901 12/1997 (EP) ..... G05F/1/56

OTHER PUBLICATIONS

"Sender und Empfänger für die optische NF–Übertragung", vol. 45, No. 12, Dec. 1, 1996, pp. 70–71, XP000682249.
Preliminary Search Report dated Jun. 23, 1999 with annex on French Application No. 9812199.

* cited by examiner

*Primary Examiner*—Peter S. Wong
*Assistant Examiner*—Bao Q. Vu
(74) *Attorney, Agent, or Firm*—Theodore E. Galanthay; Stephen C. Bongini; Fleit, Kain, Gibbons, Gutman & Bongini P.L.

(57) ABSTRACT

A voltage regulation device is provided for receiving a voltage at an input node and supplying a regulated voltage to electronic circuitry at an output node. The device includes a switching circuit that is coupled between the input node and the output node, and a control circuit that is coupled to the switching circuit. When the voltage level at the output node is below a threshold voltage, the control circuit controls the switching circuit so as to substantially short-circuit the input node and the output node. On the other hand, when the voltage level at the output node is not below the threshold voltage, the control circuit controls the switching circuit so as to substantially isolate the input node from the output node. In a preferred embodiment, the switching circuit includes an NMOS transistor, and the control circuit includes a differential amplifier that supplies a control signal to the gate of the NMOS transistor. A smart card containing a voltage regulation device is also provided.

20 Claims, 2 Drawing Sheets

VOLTAGE REGULATION DEVICE HAVING A DIFFERENTIAL AMPLIFIER COUPLED TO A SWITCHING TRANSISTOR

CROSS-REFERENCE TO RELATED APPLICATIONS

This application is based upon and claims priority from prior French Patent Application No. 98-12199, filed Sep. 30, 1998, the entire disclosure of which is herein incorporated by reference.

BACKGROUND OF THE INVENTION

1. Field of the Invention

The present invention relates to electronic circuits, and more specifically to a voltage regulation device for supplying a regulated voltage to integrated circuits in radio-frequency applications.

2. Description of Related Art

In some radio-frequency (RF) applications, an integrated circuit is powered from the RF wave that is transmitted to it. An example of an application of this type is the "contactless smart card". In this particular application, the card is powered from the RF wave transmitted by a card reader. The microcircuit (i.e., the integrated circuit chip or chips contained in the card) includes particular RF transmission/reception means for communications with a reader, and processing means for processing data such as that contained in the microcircuit memory. These various means must be supplied with a regulated voltage.

The voltage supplied to the internal circuitry must have a certain level that is as stable as possible. This is conventionally obtained by means of a shunt circuit that enables the discharging of the output node if necessary, so as to maintain the level at the output. With such a circuit, the load on the extraction device is permanent. This has an impact on the operable distance of communication between the card and the reader. The greater the power that must be extracted from the RF wave, the smaller the allowable distance between the card and the reader.

SUMMARY OF THE INVENTION

In view of these drawbacks, it is an object of the present invention to overcome the above-mentioned drawbacks and to provide a voltage regulation device with reduced power consumption in order to increase the distance allowed for transmission between a card and a reader.

Another object of the present invention is to provide a voltage regulation device with a reduced power requirement. This reduces the load on the voltage extracted from the RF wave. Thus, the reduced power consumption increasing the operable transmission distance.

One embodiment of the present invention provides a voltage regulation device of the type that receives a voltage transmitted by radio-frequency at an input node and supplies a regulated voltage to electronic circuitry at an output node. The device includes a switching circuit that is coupled between the input node and the output node, and a control circuit that is coupled to the switching circuit. When the voltage level at the output node is below a threshold voltage, the control circuit controls the switching circuit so as to substantially short-circuit the input node and the output node. On the other hand, when the voltage level at the output node is not below the threshold voltage, the control circuit controls the switching circuit so as to substantially isolate the input node from the output node. In a preferred embodiment, the switching circuit includes an NMOS transistor, and the control circuit includes a differential amplifier that supplies a control signal to the gate of the NMOS transistor.

Other objects, features, and advantages of the present invention will become apparent from the following detailed description. It should be understood, however, that the detailed description and specific examples, while indicating preferred embodiments of the present invention, are given by way of illustration only and various modifications may naturally be performed without deviating from the present invention.

DETAILED DESCRIPTION OF PREFERRED EMBODIMENTS

Preferred embodiments of the present invention will be described in detail hereinbelow with reference to the attached drawings.

Figure 1:
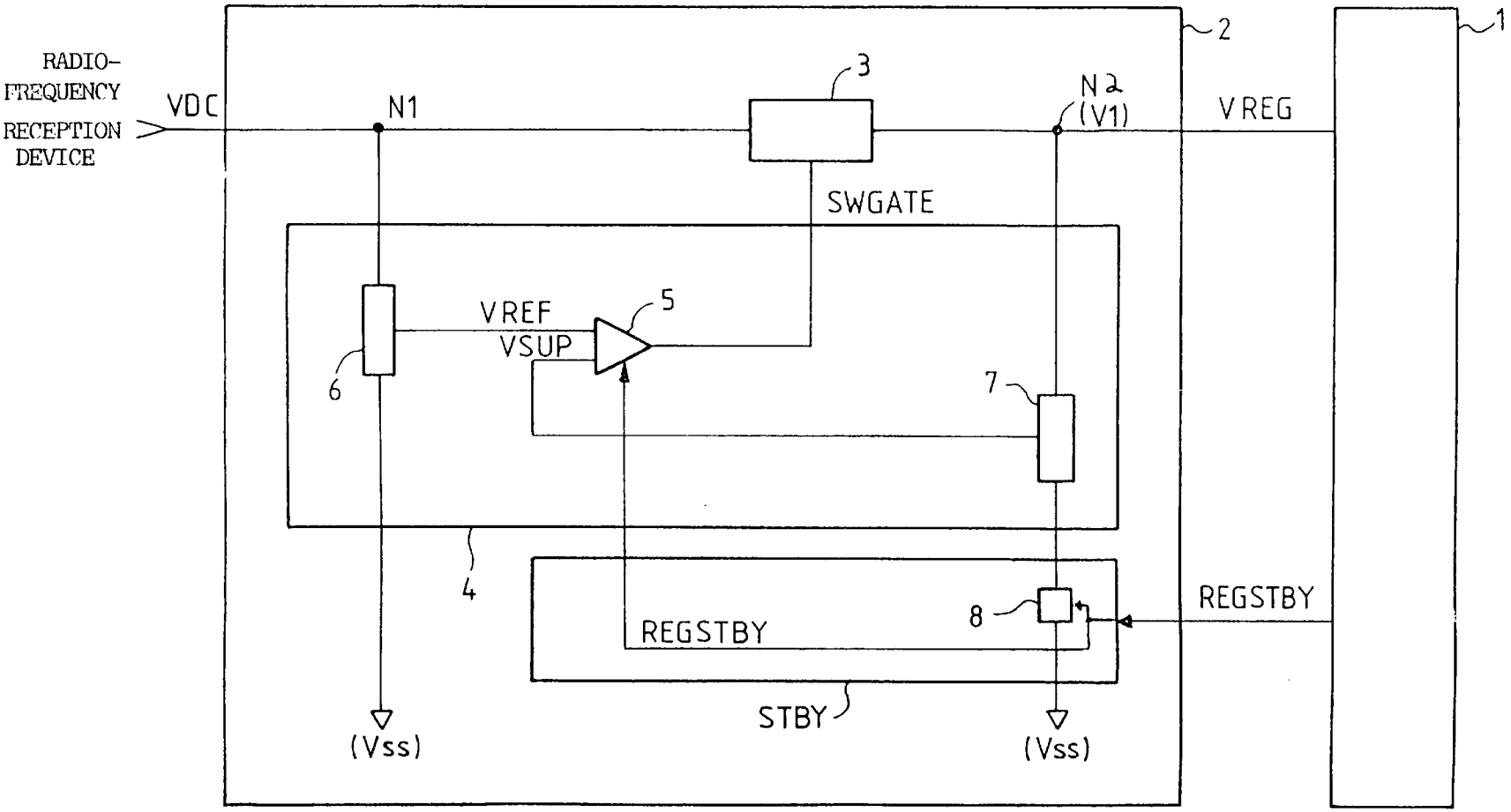
FIG. 1 is a block diagram of a regulation device according to a preferred embodiment of the present invention.

FIG. 1 shows a regulation device according to a preferred embodiment of the present invention. Internal circuitry 1 of an integrated circuit (or microcircuit) receives a regulated voltage VREG at an input from a regulation device 2. The regulation device 2 receives a voltage VDC at an input node N1. This voltage VDC is provided by an RF wave reception device (not shown) that includes a voltage extraction device. These RF waves are received from a communications system. In the exemplary application of contactless microcircuit cards, this system will be a reader. The RF wave reception device, the regulation device, and the internal circuitry 1 are preferably all internal elements of the integrated circuit.

The regulation device 2 includes a switching circuit 3 and a control circuit 4. The switching circuit 3 is connected between the input node N1 and an output node N2, which provides the regulated voltage VREG to the internal circuitry 1. When the switching circuit receives a command to close, there is a short-circuit between the input node N1 and the output node N2. When it receives an isolation command, the input node N1 is isolated from the output node N2 and there is no load at the output of the voltage extraction device (i.e., no load on the RF waves).

The control circuit 4 provides a control signal SWGATE to activate the closing or isolation (opening) of the switching circuit. The control circuit includes a comparison circuit 5 whose output is the control signal SWGATE. This comparison circuit compares the voltage VREG available at the output node of the device with a specified threshold voltage VREF and provides a command for the closure of the switching circuit (short-circuit) if the voltage controlled at output is below the threshold. If not (i.e., if the voltage is greater than or equal to the threshold), an isolation command is provided.

In the preferred embodiment, it is chosen to use the voltage at input to define the reference threshold voltage. For this purpose, the control circuit uses a divider 6 of the voltage VDC available at the input node N1. This voltage divider 6 is connected between node N1 and the electrical ground of the circuit (Vss). It provides a threshold voltage VREF. It is sized according to the application (i.e., according to the voltage VDC that can be obtained at input and the level V1 of regulated voltage VREG that is sought at output). For example, in one embodiment, the level of the input voltage may vary between 4.5 and 10 volts and, from this voltage, it is sought to obtain a regulated voltage of about 3 volts.

Preferably, the control circuit also includes a second voltage divider 7 for dividing the voltage VREG available at the output node N2 in order to provide a voltage VSUP to the comparison circuit. Thus, it is possible to play on both voltage dividers 6 and 7 to obtain the level V1 of regulated voltage sought at output. In one example, the level of the threshold voltage obtained with the divider 6 is in the range of 2 volts. The second divider 7 is sized to provide a voltage VSUP that can be compared with this threshold voltage level. The second voltage divider 7 is connected between the output node N2 and ground (Vss).

In the preferred embodiment, the regulation device also includes a deactivation circuit STBY that forces the isolation command on the switching circuit upon a command by a corresponding deactivation signal REGSTBY from the internal circuitry 1. In the exemplary embodiment of FIG. 1, this deactivation signal REGSTBY is supplied to a validation input of the comparison circuit. The deactivation circuit STBY also includes a circuit 8 that connects a ground node N3 of the second divider 7 to ground Vss or places this ground node N3 in a state of high impedance.

In this way, the voltage to be compared VSUP is set to an indeterminate state. This contributes to setting the output of the comparison circuit 5 to zero (i.e., the isolation command). When the internal circuitry has no need for the regulated voltage VREG, the input node N1 is isolated from the output node N2. Moreover, the second divider 7 no longer shunts any current. This contributes to maintaining the level at output at an undetermined state of VSVP.

Figure 2:
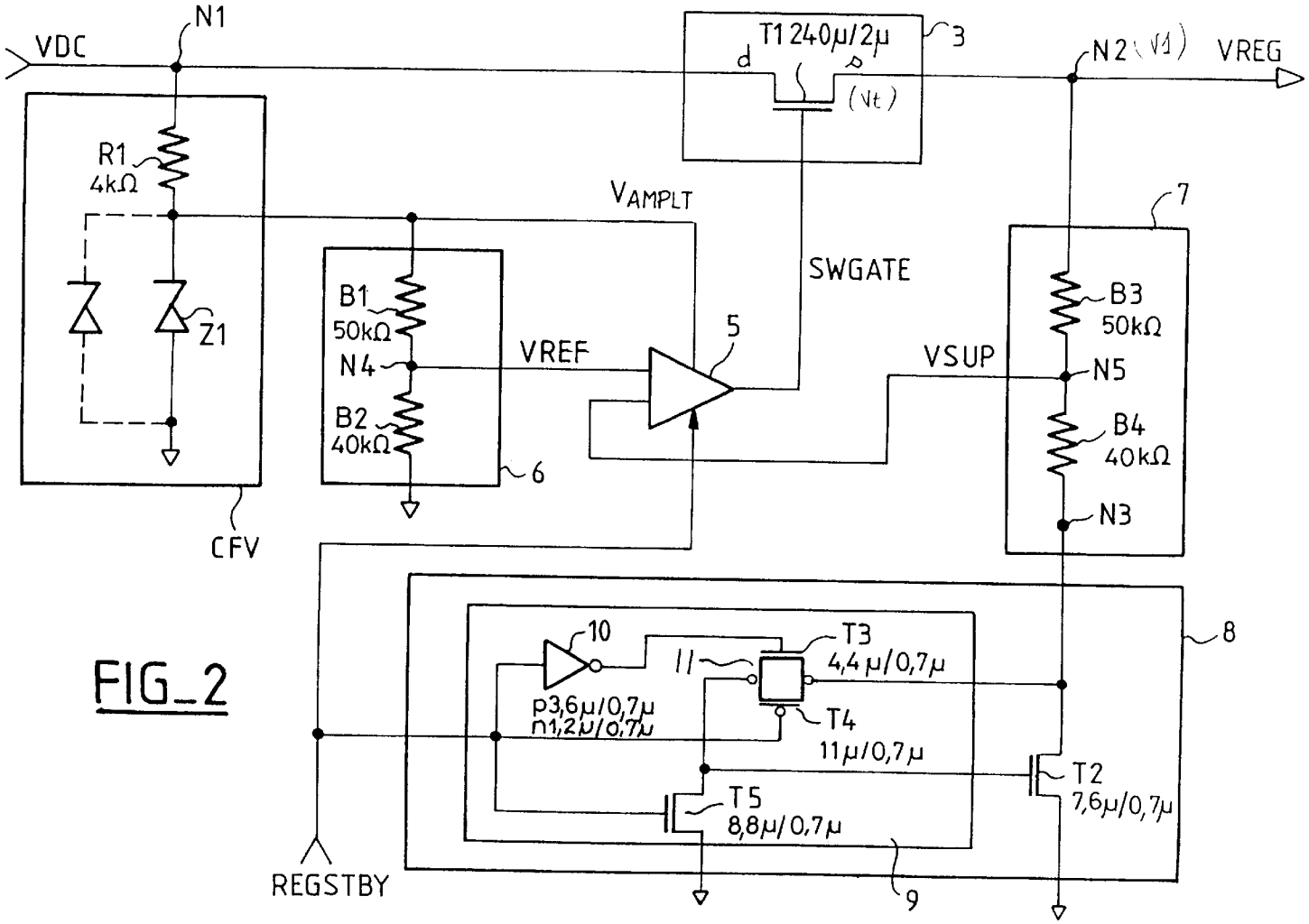
FIG. 2 is a schematic diagram of one exemplary embodiment of the regulation device of the present invention.

FIG. 2 shows one exemplary embodiment of the present invention in detail. In this embodiment, the switching circuit 3 includes an NMOS transistor T1. The closure/isolation command signal SWGATE is applied to its gate. The input node N1 is connected to its drain D and the output node N2 is connected to its source S. The comparison circuit 5 is a differential amplifier that receives the threshold voltage and the voltage to be compared. Since the signal SWGATE at its output should enable the switching over of the voltage level V1 (e.g., 3 volts) to the source for the output node N2, the voltage applied to the gate of transistor T1 should at least be equal to this voltage level plus the threshold voltage Vt of transistor T1. The signal SWGATE should therefore be at least equal to V1+Vt in order to activate the on state and switch to the voltage level V1 desired at output.

The differential amplifier should therefore be supplied with a voltage VAMPLI at least equal to V1+Vt. This is obtained in the exemplary embodiment of FIG. 2 by a circuit CFV for supplying a supply voltage VAMPLI from the voltage VDC available at the input node N1. This circuit includes a Zener diode Z1 that is reverse-biased by the input voltage VDC. Preferably, there is provided a resistor R1 connected between the input node N1 and the cathode of the Zener diode Z1 to limit the current. The anode of the Zener diode is connected to ground. The cathode of the diode provides the supply voltage VAMPLI applied to the differential amplifier 5.

In one specific embodiment, a voltage level V1 of about 3 volts is sought at the output node N2 and there is a threshold voltage Vt of about 1.5 volts for transistor T1, so it is possible to use a Zener diode with a breakdown voltage of about 4 to 5 volts. Resistor R1 is sized so that it can provide the necessary breakdown current while at the same time limit the dissipation in the diode. It is also possible to provide another Zener diode Z2 that is parallel-connected with the first diode (as shown by a dotted line in FIG. 2) for when the area of the first diode D1 is not enough to sink the breakdown current (i.e., when node N1 is at too high of a voltage level).

The divider 6 of the voltage VDC available at the input node N1 is connected between node N1 and the electrical ground Vss. It is preferably connected to the connection point between resistor R1 and Zener diode Z1. In this way, a stable voltage is found at the terminals of the divider. This stable voltage is equal to the breakdown voltage of the Zener diode and is independent of the level of the voltage VDC available at the input node, since this voltage is greater than the breakdown voltage. The voltage divider 6 includes two series connected resistive arms. In the illustrated embodiment, the first arm B1 has an equivalent resistance of 50 kiloohms, and the second arm B2 has an equivalent resistance of 40 kiloohms. The connection point N4 between the two arms provides the comparison voltage VREF.

The second voltage divider 7 is connected between the output node N2 and the ground node N3. This divider includes two series-connected resistive arms. In the illustrated example, the first arm B3 has an equivalent resistance of 50 kiloohms, and the second arm B4 has an equivalent resistance of 40 kiloohms. The connection point N5 between the two arms provides the voltage to be compared VSUP. In further embodiments, the resistors of the arms of the two dividers 6 and 7 can be different. They are each determined as a function of the level of the voltage VDC that can be extracted and of the regulated level V1 of the voltage VREG that is to be obtained at the output node N2.

In the illustrated embodiment, the regulation device further includes a circuit 8 for putting the ground node N3 of the voltage divider 7 at ground or in a state of high impedance, depending on the deactivation signal REGSTBY sent by the internal circuitry 1. The circuit 8 includes an NMOS transistor T2 series-connected between the ground node N3 and electrical ground Vss. The gate of transistor T2 is controlled by the deactivation signal REGSTBY through a control circuit 9. This control circuit 9 includes an inverter 10 that receives the signal REGSTBY at input. The output of this inverter is applied to the gate of an NMOS transistor T3 of a passgate 11. The gate of a PMOS transistor T4 of the passgate 11 is directly controlled by the signal REGSTBY. The passgate 11 is connected between the gate of transistor T2 and the ground node N3 of the divider 7. Further, an NMOS transistor T5 is connected between the gate of transistor T2 and ground, and is controlled at its gate by the signal REGSTBY.

During operation, if the signal REGSTBY is inactive (i.e., at "1" in this embodiment) to indicate that the internal circuitry needs the regulated voltage VREG, the passgate 11 is off, and transistors T2 and T5 are on. The voltage divider 7 has its ground node N3 connected to the electrical ground by transistor T2. If, on the contrary, the internal circuitry does not need the regulated voltage VREG available at the output N2, the signal REGSTBY goes to its active level (i.e., "0" in this embodiment). Thus, the passgate 11 goes on and transistors T2 and T5 are off, so as to force a state of high impedance on the ground node N3. It is then no longer possible for any current to go into the divider. The node N5 thus goes into a state of high impedance.

There is then no longer any comparison possible and the output of the differential amplifier remains at zero (with the switch in an open state). This is accentuated by the application of signal REGSTBY to an invalidation input of the differential amplifier 5. This invalidation input allows the setting of the ground connection node of the differential amplifier to a state of high impedance. In another embodiment of the regulation device of the present invention, a capacitor C1 is provided on the output node N2 in order to smooth the level of the output voltage of the device. This capacitor is preferably connected between the node N2 and electrical ground.

With the sizing of the various elements of the regulation device as indicated in FIG. 2 in an HCMOS7 (0.7 micron) technology, and with the typical threshold voltage values of NMOS and PMOS transistors in this technology, it becomes possible to obtain a regulated voltage level VREG at output of:

2.37 volts with an input voltage VDC of 4.5 volts, to 3.16 volts with an input voltage VDC of 10 volts at −25° C.;

2.45 volts with an input voltage VDC of 4.5 volts, to 3.25 volts with an input voltage VDC of 10 volts at +27° C.; and 2.50 volts with an input voltage VDC of 4.5 volts, to 3.45 volts with an input voltage VDC of 10 volts at +85° C.

By no longer using the typical mean values of the threshold voltages of the transistors, but instead their minimum or maximum values in the technology, there is obtained, at +27° C., a level of regulated voltage VREG at output of:

2.45 volts with an input voltage VDC of 4.5 volts, to 3.33 volts with an input voltage VDC of 10 volts at $VtN_{max}$ and $VtP_{min}$;

2.40 volts with an input voltage VDC of 4.5 volts, to 3.17 volts with an input voltage VDC of 10 volts at $VtN_{min}$ and $VtP_{max}$;

2.38 volts with an input voltage VDC of 4.5 volts, to 3.15 volts with an input voltage VDC of 10 volts at $VtN_{min}$ and $VtP_{min}$; and 2.47 volts with an input voltage VDC of 4.5 volts, to 3.36 volts with an input voltage VDC of 10 volts at $VtN_{max}$ and $VtP_{max}$.

Accordingly, the regulation device of the present invention provides a very stable voltage at its output. The present invention is particularly suited for use with contactless microcircuit cards.

While there has been illustrated and described what are presently considered to be the preferred embodiments of the present invention, it will be understood by those skilled in the art that various other modifications may be made, and equivalents may be substituted, without departing from the true scope of the present invention. Additionally, many modifications may be made to adapt a particular situation to the teachings of the present invention without departing from the central inventive concept described herein. Furthermore, an embodiment of the present invention may not include all of the features described above. Therefore, it is intended that the present invention not be limited to the particular embodiments disclosed, but that the invention include all embodiments falling within the scope of the appended claims.

What is claimed is:

1. A voltage regulation device of the type that receives a voltage transmitted by radio-frequency at an input node and supplies a regulated voltage to electronic circuitry at an output node, said device comprising:

a switching transistor coupled between the input node and the output node;

a differential amplifier coupled to the switching transistor; and means for providing a stable predetermined voltage to the supply voltage input of the differential amplifier, the predetermined voltage being less than the voltage level at the input node and at least equal to the desired level of the regulated voltage plus the threshold voltage of the switching transistor, wherein when the voltage level at the output node is below a threshold voltage, the differential amplifier controls the switching transistor so as to substantially short-circuit the input node and the output node, and when the voltage level at the output node is not below the threshold voltage, the differential amplifier controls the switching transistor so as to substantially isolate the input node from the output node.

2. The voltage regulation device as defined in claim 1, further comprising a capacitor coupled to the output node.

3. The voltage regulation device as defined in claim 1, wherein the means for providing includes at least one diode that is reverse-biased by the voltage at the input node.

4. The voltage regulation device as defined in claim 1, wherein the means for providing includes:

at least one Zener diode that is reverse-biased by the voltage at the input node; and at least one resistor coupled between the Zener diode and the input node.

5. The voltage regulation device as defined in claim 4, further comprising a first voltage divider that divides the voltage at the input node to produce a threshold voltage that is supplied to one input of the differential amplifier.

6. The voltage regulation device as defined in claim 5, further comprising a second voltage divider that divides the voltage at the output node to produce another voltage that is supplied to another input of the differential amplifier.

7. The voltage regulation device as defined in claim 6, further comprising a deactivation circuit for forcing the switching transistor to substantially isolate the input node from the output node when a standby command is received from the electronic circuitry.

8. The voltage regulation device as defined in claim 7, wherein the deactivation circuit includes a circuit for either coupling a ground node of the second voltage divider to electrical ground, or placing the ground node of the second voltage divider in a state of high impedance.

9. The voltage regulation device as defined in claim 5, wherein the first voltage divider is connected to a connection point between the resistor and the Zener diode.

10. The voltage regulation device as defined in claim 1, further comprising a deactivation circuit for forcing the switching transistor to substantially isolate the input node from the output node when a standby command is received from the electronic circuitry.

11. A smart card comprising:

a radio-frequency reception device;

internal circuitry; and a voltage regulation device coupled between the radio-frequency reception device and the internal circuitry, the radio-frequency reception device providing a voltage at an input node of the voltage regulation device, and the internal circuitry receiving a regulated voltage from an output node of the voltage regulation device, wherein the voltage regulation device includes:

a switching transistor coupled between the input node and the output node;

a differential amplifier coupled to the switching transistor; and means for providing a stable predetermined voltage to the supply voltage input of the differential amplifier, the predetermined voltage being less than the voltage level at the input node and at least equal to the desired level of the regulated voltage plus the threshold voltage of the switching transistor, and the voltage regulation device operates such that:

when the voltage level at the output node is below a threshold voltage, the differential amplifier controls the switching transistor so as to substantially short-circuit the input node and the output node, and when the voltage level at the output node is not below the threshold voltage, the differential amplifier controls the switching transistor so as to substantially isolate the input node from the output node.

12. The smart card as defined in claim 11, wherein the voltage regulation device further includes a capacitor coupled to the output node.

13. The smart card as defined in claim 11, wherein the means for providing includes at least one diode that is reverse-biased by the voltage at the input node.

14. The smart card as defined in claim 11, wherein the means for providing includes:

at least one Zener diode that is reverse-biased by the voltage at the input node; and at least one resistor coupled between the Zener diode and the input node.

15. The smart card as defined in claim 14, wherein the voltage regulation device further includes:

a first voltage divider that divides the voltage at the input node to produce a threshold voltage that is supplied to one input of the differential amplifier; and a second voltage divider that divides the voltage at the output node to produce another voltage that is supplied to another input of the differential amplifier.

16. The smart card as defined in claim 15, wherein the voltage regulation device further includes a deactivation circuit for forcing the switching transistor to substantially isolate the input node from the output node when a standby command is received from the internal circuitry.

17. The smart card as defined in claim 16, wherein the deactivation circuit includes a circuit for either coupling a ground node of the second voltage divider to electrical ground, or placing the ground node of the second voltage divider in a state of high impedance.

18. The smart card as defined in claim 11, wherein the voltage regulation device further includes a deactivation circuit for forcing the switching transistor to substantially isolate the input node from the output node when a standby command is received from the internal circuitry.

19. The voltage regulation device as defined in claim 1, further comprising a voltage divider that divides the stable predetermined voltage to produce a stable threshold voltage that is supplied to one input of the differential amplifier.

20. A voltage regulation device of the type that receives a voltage at an input node and supplies a regulated voltage at an output node, said device comprising:

a switching transistor coupled between the input node and the output node;

a differential amplifier coupled to the switching transistor;

means for providing a first predetermined voltage to the supply voltage input of the differential amplifier, the first predetermined voltage being less than the voltage level at the input node and at least equal to the desired level of the regulated voltage plus the threshold voltage of the switching transistor; and a voltage divider for dividing the first predetermined voltage that is provided to the supply voltage input of the differential amplifier to produce a second predetermined voltage that is supplied as a threshold voltage to one input of the differential amplifier, wherein when the voltage level at the output node is below the threshold voltage the differential amplifier controls the switching transistor so as to substantially short-circuit the input node and the output node, and when the voltage level at the output node is not below the threshold voltage, the differential amplifier controls the switching transistor so as to substantially isolate the input node from the output node.

* * * * *